US005634085A

United States Patent [19]

Yoshikawa et al.

[11] Patent Number: 5,634,085

[45] Date of Patent: *May 27, 1997

[54] SIGNAL REPRODUCING DEVICE FOR REPRODUCTING VOICE SIGNALS WITH STORAGE OF INITIAL VALVES FOR PATTERN GENERATION

[75] Inventors: Shuichi Yoshikawa, Nara; Yasumoto Murata, Ikoma-gun; Yuji Nishiwaki, Nara, all of Japan

[73] Assignee: Sharp Kabushiki Kaisha, Osaka, Japan

[ * ] Notice: The term of this patent shall not extend beyond the expiration date of Pat. No. 5,325,463.

[21] Appl. No.: 112,302

[22] Filed: Aug. 27, 1993

Related U.S. Application Data

[63] Continuation of Ser. No. 798,723, Nov. 27, 1991, abandoned.

[30] Foreign Application Priority Data

Nov. 28, 1990 [JP] Japan ..... 2-332001
Mar. 11, 1991 [JP] Japan ..... 3-045200

[51] Int. Cl.[6] ..... G10L 5/02

[52] U.S. Cl. ..... 395/2.75; 395/2.76

[58] Field of Search ..... 395/2.1–2.34, 395/2.39, 2.75, 2.74, 2.76; 381/29–40

[56] References Cited

U.S. PATENT DOCUMENTS

| | | | |
|---|---|---|---|
| 4,185,325 | 1/1980 | Appel | 365/244 |
| 4,209,844 | 6/1980 | Brantingham et al. | 364/724 |
| 4,631,747 | 12/1986 | Tardif | 381/51 |
| 4,794,645 | 12/1988 | Watari | 381/43 |
| 4,896,361 | 1/1990 | Gerson | 381/40 |
| 4,933,957 | 6/1990 | Bottau et al. | 375/27 |
| 5,086,471 | 2/1992 | Tanaka et al. | 395/2.31 |
| 5,119,425 | 6/1992 | Rosenstrach et al. | 381/51 |
| 5,245,662 | 9/1993 | Taniguchi et al. | 395/2.32 |
| 5,323,486 | 6/1994 | Taniguchi et al. | 395/2.29 |
| 5,325,463 | 6/1994 | Murata et al. | 395/2.75 |
| 5,361,323 | 11/1994 | Murata et al. | 395/2.1 |
| 5,504,835 | 4/1996 | Yoshikawa et al. | 395/2.67 |

OTHER PUBLICATIONS

Trancoso, I.M., et al, Proc. ICASSP, pp. 2375–2378, Apr. 1986, "Efficient Procedures For Finding The Optimum Innovation".

ICASSP '87 Proceedings, vol. 3, 6 Apr. 1987, Dallas, Texas, US, pp. 1354–1357, D. Lin "Speech coding using efficient pseudo–stochastic block codes".

ICASSP '84 Proceedings, vol. 1, 19 Mar. 1984, San Diego, California US, pp. 1121–1124, J. P. Adoul et al, "Baseband speech coding at 2400 bps using spherical vector quantization".

Electronics Letters, vol. 23, No. 6, 12 Mar. 1987, Hitchin GB, pp. 253–254, P. G. Hammet, "Complexity reduction in fully vector quantised stochastic coders".

International Journal of Electronics, vol. 63, No. 6, Dec. 1987, London GB, pp. 885–889, M. K. Mahmood et al, "Noise generator with programmable distribution".

Eurospeech 89, vol. 1, Sep. 1989, Paris France, pp. 322–325, N. Moreau et al, "Mixed excitation CELP coder".

*Primary Examiner*—Allen R. MacDonald
*Assistant Examiner*—Joh Michael Grover
*Attorney, Agent, or Firm*—Nixon & Vanderhye P.C.

[57] ABSTRACT

In a signal reproducing device for reproducing voice signals from vector-quantized coded data, transferred or recorded coded data is extracted one by one, and the coded data extracted are given as initial values to a recurrence equation to generate a pattern composed of a predetermined number of data for every initial value. The thus generated patterns are sequentially output as reproduction data.

19 Claims, 5 Drawing Sheets

SIGNAL REPRODUCING DEVICE FOR REPRODUCTING VOICE SIGNALS WITH STORAGE OF INITIAL VALVES FOR PATTERN GENERATION

This is a continuation of application Ser. No. 07/798,723, filed Nov. 27, 1991, now abandoned.

BACKGROUND OF THE INVENTION

1. Field of the Invention

This invention relates to a signal reproducing device for reproducing voice signals or the like from vector-quantized coded data.

2. Description of the Prior Art

In electronic devices which produce voice messages, voice guidance, etc. using a simple hardware configuration, a voice reproducing device performs vector pulse code modulation (VPCM) in which a low-bit code book is used for vector quantization.

FIG. 6 shows a voice reproducing device performing VPCM. In the voice reproducing device of FIG. 6, patterns stored in a code book 102 are read out as required in accordance with voice signal coded data recorded in a data ROM 101, and the thus read out patterns are sequentially converted into analog signals by a D/A converter 103. The analog signals are passed through a filter 104 for removing aliasing noise, and then amplified by an amplifier 105 to reproduce the voice information through a loudspeaker 106. The code book 102 is a byte address ROM containing 256 patterns, each pattern (representative vector) being composed of a combination of eight samples (eight bytes) of 8-bit (1-byte) data. Each pattern can be accessed using address data input to the upper 8-bit address inputs ($A_3$–$A_{10}$) of the code book 102 (i.e. in units of eight bits). The data ROM 101 contains various combinations of the 8-bit address data of the code book 102, in the form of coded data. These address data of the data ROM 101 are sequentially read out to the code book 102 by an address counter 108 that,operates according to the output of an oscillator 107. On the other hand, the lower three bits ($P_0$–$P_2$) of the count outputs of the address counter 108 are connected directly to the lower 3-bit address inputs ($A_0$–$A_2$) of the code book 102. In the code book 102, therefore, each pattern is selected using the upper 8-bit address given from the data ROM 101, and eight samples of data for the selected pattern are sequentially fed in blocks of eight bits to the D/A converter 103 in accordance with the lower three bits ($P_0$–$P_2$) of the output of the address counter 108.

As a result, in the above voice signal reproducing device utilizing VPCM, a voice signal of 64 bits (8 bits×8 samples) can be compressed to 8-bit address data for storage in the data ROM 101.

The coded data contained in the data ROM are previously generated by vector quantization in which patterns closest to the voice signals to be coded are sequentially selected from the above-mentioned code book. When encoding the voice signals, therefore, all the patterns in the code book need to be sequentially read out for comparison for every eight samples of each voice signal. In contrast, when reproducing the voice signals, realtime processing can be achieved easily by random-accessing the code book using the coded data.

However, the above prior art voice signal reproducing device utilizing VPCM has a problem in that the code book 102 requires a large capacity for storing a number of patterns (in the above example, 16 kilobits (=8 bits×8 samples×256 patterns)). This memory capacity requirement is still too severe to make the hardware configuration simple enough. Furthermore, the plurality of patterns stored in the code book 102 must be selected on the basis of the actually used voice data so that the quantization error distribution in the vector quantization can be minimized. As a result, these patterns are dependent on the actually used voice data, and when the voice data are changed, the patterns must be reselected to match the new voice data. This impairs the versatility of the ROM that constitutes the code book 102, preventing the reduction of costs by mass production.

SUMMARY OF THE INVENTION

The signal reproducing device of this invention, which overcomes the above-discussed and numerous other disadvantages and deficiencies of the prior art, comprises: coded data extracting means for extracting transferred or recorded coded data one by one; pattern generating means for sequentially giving the coded data extracted by said coded data extracting means as initial values to a recurrence equation, and for sequentially generating a pattern composed of a predetermined number of data for every initial value; and reproduction data output means for sequentially outputting the patterns generated by said pattern generating means as reproduction data.

In another aspect of the invention, the signal reproducing device of the invention comprises: coded data extracting means for sequentially extracting a plurality of transferred or recorded coded data; a plurality of pattern generating means, each of said pattern generating means giving one of the plurality of coded data extracted by said coded data extracting means as an initial value to a recurrence equation, and for generating a pattern composed of a predetermined number of data for every initial value; and reproduction data output means for performing a predetermined operation on the respective patterns generated by said plurality of pattern generating means, and for sequentially outputting the result of said operation as reproduction data.

In the above-mentioned configurations, said coded data extracting means sequentially may extract gain adjustment data transferred or recorded along with coded data, and said reproduction data output means may perform gain adjustment for each corresponding pattern on the basis of the gain adjustment data extracted by said coded data extracting means.

Alternatively, in the above-mentioned configurations, said coded data extracting means may further sequentially extract operating speed data transferred or recorded along with the coded data, and said device may further comprise an oscillator, the oscillation frequency of said oscillator varying on the basis of the operating speed data extracted by said coded data extracting means and being supplied as an operating frequency to said coded data extracting means, pattern generating means, and reproduction data output means.

In a further aspect of the invention, the signal reproducing device of the invention comprises: coded data extracting means for extracting initial value data one by one from transferred or recorded coded data, and for extracting coefficient data one by one for every extraction of a plurality of initial value data; pattern generating means for sequentially giving the initial value data extracted by said coded data extracting means as initial values to a recurrence equation, and for generating patterns each composed of a predetermined number of digital data for every initial value; reproduction data output means for sequentially outputting the patterns generated by said pattern generating means as reproduction data; and coefficient setting means for sequentially setting the coefficient data extracted by said coded data extracting means as bandwidth limiting coefficients for said reproduction data output means.

In a signal reproducing device of the invention, the coded data extracting means sequentially extracts transferred or recorded coded data one by one. When the coded data are stored in memory, the coded data extracting means reads out the coded data by sequentially accessing the memory using an address counter or the like. On the other hand, when the coded data are those transferred from another device, the coded data extracting means performs such processing as splitting the coded data or converting them to a parallel signal.

As the coded data are extracted one by one by the coded data extracting means, the pattern generating means sequentially gives the thus extracted data as initial values to a recurrence equation, thereby generating patterns each composed of a predetermined number of data for every initial value. The recurrence equation (difference equation) is an equation for infinitely generating data trains by sequentially performing calculations with given initial values. With the same initial value, generated data trains are always the same. Therefore, using the recurrence equation, it is possible to generate desired data trains by giving initial values, i.e., to random access the patterns. The recurrence equation may be implemented either by software or by hardware.

The recurrence equation may be equivalent to that used for the encoding process in vector quantization. In the encoding process, a large number of patterns generated by sequentially giving initial values to the recurrence equation are each compared with signals of a predetermined number of samples, and the initial value for the recurrence equation which achieves the closest pattern is set to the encoded data. In this encoding, a code book may be used in which the relationship between the address and the pattern stored at that address is equivalent to the relationship between the initial value for the recurrence equation and the pattern generated by that initial value. As a result, each pattern generated by the pattern generating means is the pattern obtained by decoding the coded data. Using the recurrence equation, a predetermined number of calculations are performed with a given initial value, to generate a pattern of a larger bit count than the initial value. This means that the transferred or recorded coded data that provides the initial value is generated by compressing the pattern to be reproduced. However, the pattern may be composed of part of a data train which is generated as a result of a predetermined number of calculations performed with each given initial value to recurrence equation.

Each pattern used for the encoding process serves as a representative vector in vector quantization. Therefore, when a pattern composed of an N number of data is considered an N-dimensional vector, patterns generated by the recurrence equation with given initial values must be distributed as evenly as possible in the N-dimensional signal vector space. As a recurrence equation generating such patterns, pseudo-random numbers are presented for example.

For example, the congruential method using the following recurrence equation:

$$Z_i = a \cdot Z_{i-1} + b \pmod{m}$$

is a typical one for generating pseudo-random numbers. Since regularity of lattice structure occurs in a multidimensional space, it is not exactly the best one as a recurrence equation for generating patterns that serve as representative vectors.

On the other hand, for example, the maximum-length linearly recurring sequence (M-sequence) using the following recurrence equation:

$$Z_i = Z_{i-24} + Z_{i-55} \pmod{m}$$

offers the advantage that a uniform distribution can be obtained even in a multidimensional space and can be achieved by a simple hardware using a shift register. In the invention, it is sufficient to provide by using a recurrence equation representative vectors which are uniformly distributed in the signal vector space regardless of the sequence of their generation, and therefore, all the properties of random numbers are not necessarily required. Therefore, a recurrence equation which is not very suitable for generation of random numbers or which sequentially generates patterns may regularly be acceptable. In the generation of pseudo-random numbers, the initial value is called the seed.

When the patterns have been generated by the pattern generating means as described above, the reproduction data output means sequentially outputs the patterns as reproduction data. The patterns may be output as reproduced data in the form of analog signals after digital-to-analog conversion.

Thus, the transferred or recorded coded data are converted to patterns of a longer bit length, and then output as reproduction data. According to the invention, data can be transferred or recorded in a compressed form as in the prior art signal reproducing device using VPCM. Since the patterns, the representative vectors used for reproduction, are generated by using a recurrence equation, random access is possible as in the case of a code book, and furthermore, since there is no need to provide a large-capacity memory such as a code book, the hardware can be made simple. Also, since the number of patterns to be generated can be increased easily without straining the hardware, the same signal reproducing device can be used even when the original signal data have been changed, thus making possible the versatility of the hardware.

According to another embodiment of the invention, more than one coded data extracting means and pattern generating means are provided so that reproduction data are output based on the plurality of patterns generated by the respective pattern generating means. Therefore, for example, when one of the coded data is obtained by vector quantization of the original signal, as described above, and the other coded data is obtained by vector quantization of the waveform representing the residual between the pattern represented by the first coded data and the actual signal, it is possible to enhance the reproduction quality although the data compression ratio somewhat decreases. In this embodiment, the reproduction data output means calculates the difference between the two patterns and outputs the result as the reproduction data.

In an embodiment in which the coded data extracting means extracts gain adjustment data along with coded data and the reproduction data output means adjusts the gain for each corresponding pattern on the basis of the thus extracted gain adjustment data, the gain adjustment data may be generated beforehand in the following manner: when comparing the pattern with the original signal in the encoding process, the gain for the pattern is previously adjusted in such a manner as to minimize the difference between them, and the amount of gain adjustment for the thus selected pattern is transferred or recorded as the gain adjustment data along with the coded data. Therefore, if there is a pattern which is quite similar in waveform to but different only in level from the original signal, the initial value for this pattern can be adopted as coded data. This contributes to enhancing the reproduction quality although the data compression ratio somewhat decreases.

In an embodiment in which the coded data extracting means extracts operating speed data along with coded data and the operating speed of the coded data extracting means, pattern generating means and reproduction data output means is varied on the basis of the thus extracted operating speed data, the operating speed data is generated beforehand in the following manner: when a certain occasion has occurred in the encoding process (e.g., when the difference between the original signal and the closest pattern obtained has been greater than the threshold value), the encoding process is performed over again with a higher operating speed, and the data representing this operating speed is transferred or recorded along with the coded data. Since the operating frequency for encoding can thus be varied adaptively, reproduction of enhanced quality is realized although the data compression ratio somewhat decreases.

In the signal reproducing device having a coefficient setting means for sequentially setting bandwidth limiting coefficients for the reproduction data output means, the bandwidth limiting coefficients are updated on the basis of the coefficient data every time the coded data extracting means extracts the coefficient data. The coefficient data is added to the coded data for every predetermined number of initial value data, and is generated beforehand so as to minimize the quantization error when vector-quantizing the original signal with the predetermined number of initial value data. Therefore, the bandwidth limiting characteristics of the reproduction data output means are updated to optimum values every time the predetermined number of patterns have been output.

Thus, the invention described herein makes possible the objectives of:

(1) providing a signal reproducing device which can operate with a small-capacity code book;

(2) providing a signal reproducing device which can operate with a versatile code book;

(3) providing a signal reproducing device which can be manufactured at a reduced cost; and (4) providing a signal reproducing device which can reproduce signals with a high quality.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

The preferred embodiments of the invention will now be described with reference to the accompanying drawings.

Figure 1:
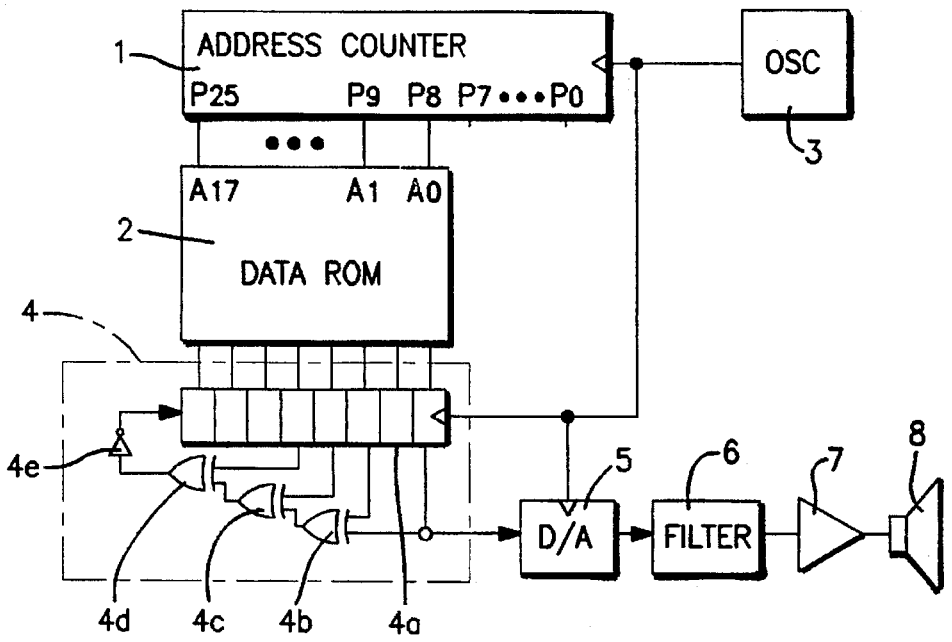
FIG. 1 is a block diagram illustrating an embodiment of the invention.

FIG. 1 illustrates a voice signal reproducing device according to the invention. In the signal reproducing device of this embodiment, the higher 18 bits ($P_{25}$–$P_8$) of the output of an address counter 1 are connected to the 18-bit address input ($A_{17}$–$A_0$) of a data ROM 2. The address counter 1 sequentially counts the 26-bit output on the basis of the oscillation frequency (8,000 Hz) of an oscillator 3. Since the lower eight bits ($P_7$–$P_0$) of the output of the address counter 1 are not used, the address counter 1 provides the count outputs to the data R0M 2 at a rate of 32×(⅛) of the oscillation frequency of the oscillator 3. The data ROM 2 is a byte address ROM in which 8-bit coded data are stored in address sequence. The eight bits of a coded data in the data R0M 2 are addressed by the count outputs of the address counter 1, and then are input in parallel to an 8-bit shift register 4*a* in a pseudo-random number generator 4.

In the pseudo-random number generator 4, each bit in the shift register 4*a* is sequentially shifted to the next higher significant place in accordance with the oscillation frequency of the oscillator 3. The bits in the eighth and sixth stages of the shift register 4*a* are XORed by an exclusive-OR (XOR) circuit 4*b*, and the result of the XOR operation is further XORed with the bit in the fifth stage by an XOR circuit 4*c* The output of the XOR circuit 4*c* is further XORed with the bit in the fourth stage by an XOR circuit 4*d*, and finally, the result of this XOR operation is inverted by a NOT circuit 4*e* and then input to the first stage of the shift register 4*a* to generate M-sequence random numbers. The eighth stage bit is output serially. That is, the pseudo-random number generator 4 is capable of generating an 8-bit pseudo-random number based on the initial value at a cycle of 256 ($=2^8$), which means that, every time one coded data is given as the initial value from the data ROM 2, the shift register 4*a* performs a shift operation 32×8 times to output thirty-two 8-bit data as one pattern.

Each pattern thus output sequentially from the pseudo-random number generator 4 is converted to an analog signal by a D/A converter 5 which operates with the oscillation frequency of the oscillator 3. Then, after removal of aliasing noise by a filter 6, each pattern is amplified by an amplifier 7 to be output as a voice through a loudspeaker 8.

The coded data stored in the data ROM 2 are previously generated by vector quantization by comparing every block of 32 samples of the original voice signal to be coded against all the patterns produced by the same pseudo-random numbers as those generated by the pseudo-random number generator 4, and by sequentially outputting the initial value for the pattern closest to the original voice signal. Therefore, each pattern sequentially output from the pseudo-random number generator 4 on the basis of the initial value which is the coded data read from the data ROM 2 is the closest to the waveform representing the 32 samples of the original voice signal. Based on this pattern, the original voice is reconstructed and reproduced through the loudspeaker 8. The coded data contains the voice signal of 8 bits×32 samples in the form of 8-bit compressed data which is given as the initial value to the pseudo-random number generator 4.

As a result, according to this embodiment, the pseudo-random number generator 4 of the simple configuration, comprising the shift register 4*a*, XOR circuits 4*b*–4*d* and NOT circuit 4*e*, is capable of generating 256 different patterns each representing 8 bits×32 samples. This permits reproduction of the original voice signal without using a code book constructed with a large-capacity memory.

Figure 2:
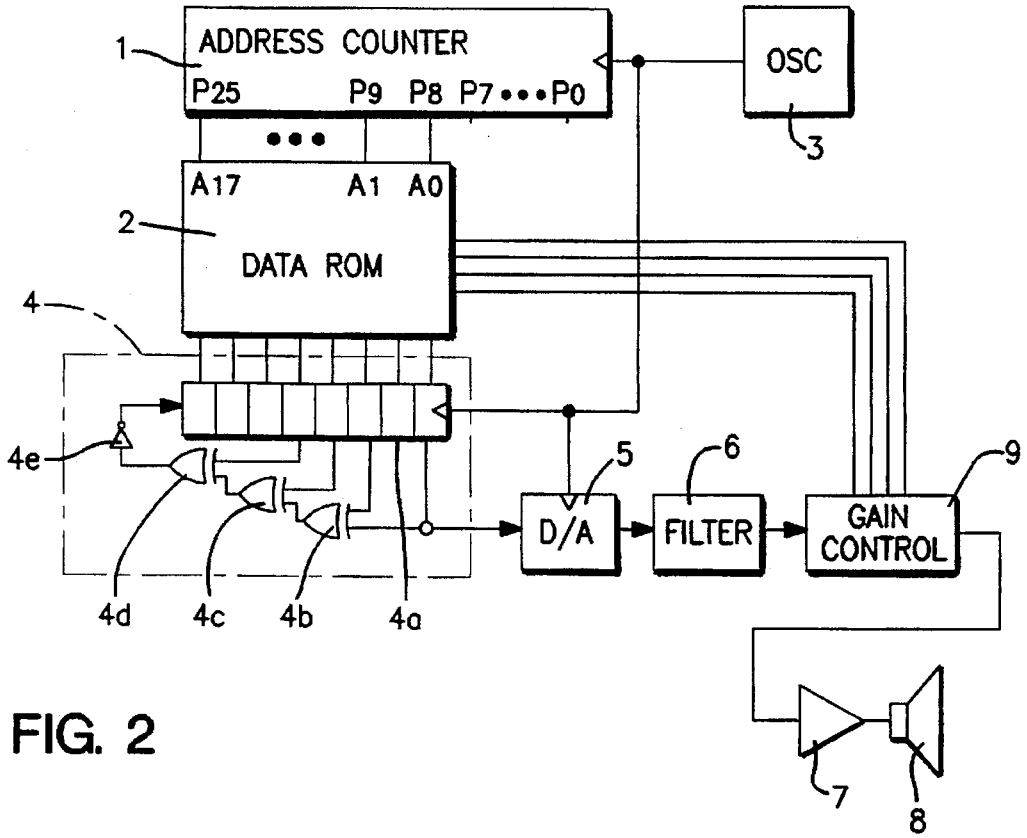
FIG. 2 is a block diagram illustrating another embodiment of the invention.

FIG. 2 shows another embodiment of the present invention. In this embodiment, the data ROM 2 is a 12-bit address ROM. At each address, 4-bit gain adjustment data and 8-bit coded data are stored. The gain adjustment data read out together with the coded data from the data ROM 2 is supplied to a gain controller 9. The gain controller 9 is inserted between the filter 6 and the amplifier 7 in the voice reproducing device shown in FIG. 1, and controls the gain of an analog signal.

The gain adjustment data stored in the data ROM 2 is generated beforehand in the following manner: when vector-quantizing the voice signal, the gain is adjusted so as to minimize the difference between the voice signal and the pattern to be compared, and then the comparison with the voice signal is conducted, and the gain adjustment amount for the pattern selected as a result of this comparison is obtained as the gain adjustment data to be stored in the data ROM 2 along with the coded data. Therefore, if there is a pattern which is quite similar in waveform to but different only in level from the original signal, the initial values for this pattern can be adopted as coded data.

As a result, the number of the types of the patterns that can be output through the gain controller 9 is approximately equivalent to a 12-bit configuration (the 12th power of 2) which is the sum of 8 bits of the coded data and 4 bits of the gain adjustment data. This contributes to enhancing the quality of voice reproduction although the data compression ratio decreases.

Figure 3:
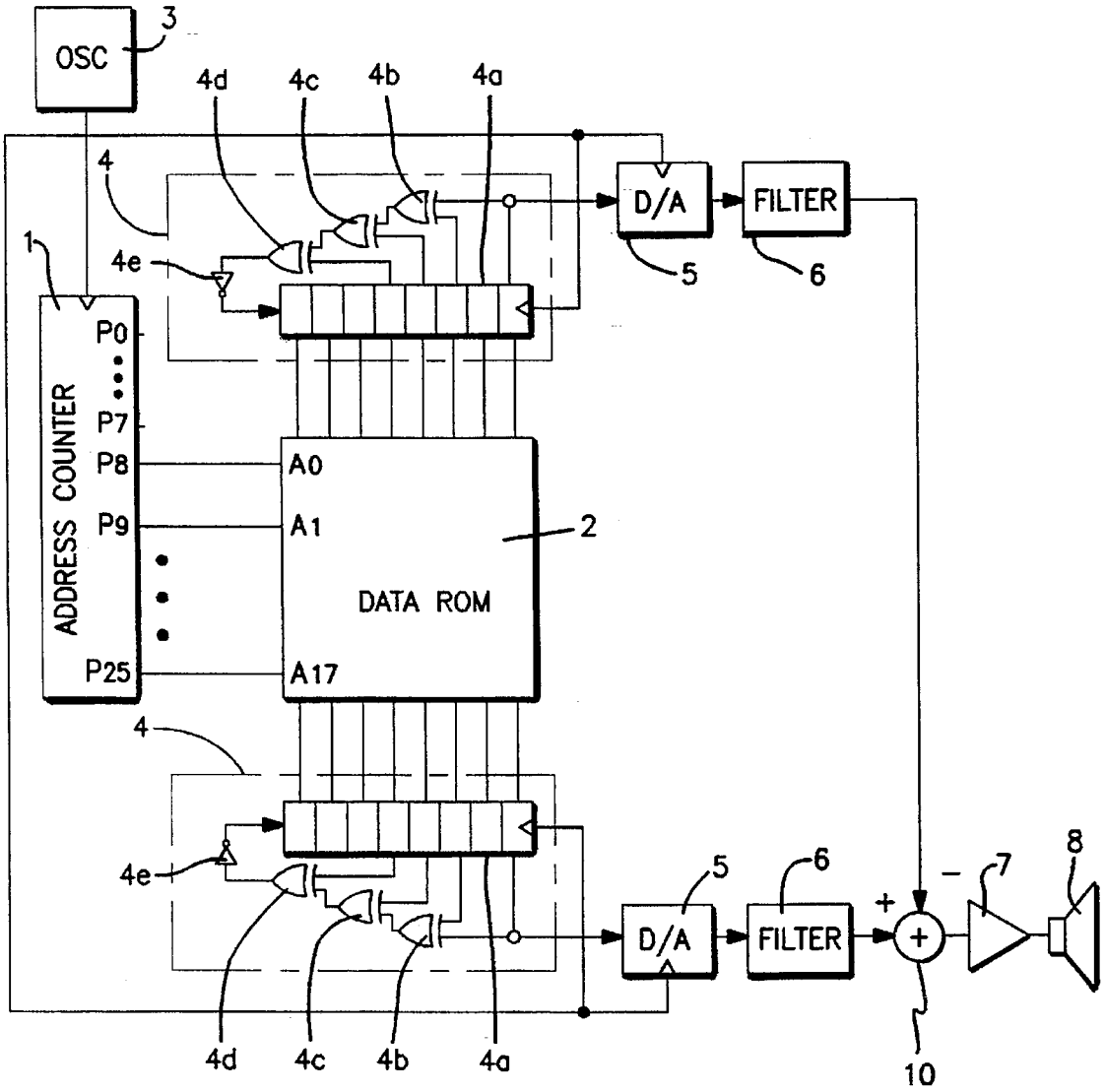
FIG. 3 is a block diagram illustrating a further embodiment the invention.

FIG. 3 illustrates a further embodiment of the present invention. In this embodiment, the data ROM 2 is a word (16-bit) address ROM, each address containing two kinds of 8-bit coded data. This embodiment is provided with two sets of a pseudo-random number generator 4, a D/A converter 5 and a filter 6, so that two kinds of coded data are read from the data ROM 2 and respectively subjected to the same processing as in the first embodiment of FIG. 1, to produce analog signals. These analog signals are input to an adder 10 where one analog signal is subtracted from the other, and the result is amplified by an amplifier 7 and reproduced as a voice through a loudspeaker 8.

Of the two kinds of coded data stored in the data ROM 2, one is generated by comparing each pattern with the original voice data in the same manner as in the foregoing embodiment, and the other is generated by recomparing the pattern with respect to the residual (quantization error) caused between the voice data and the selected pattern.

Since the residual signal is subtracted by the adder 10 from the analog signal containing a certain amount of quantization error, the quantization error can be reduced, which contributes to enhancing the quality of voice reproduction although the data compression ratio decreases.

Figure 4:
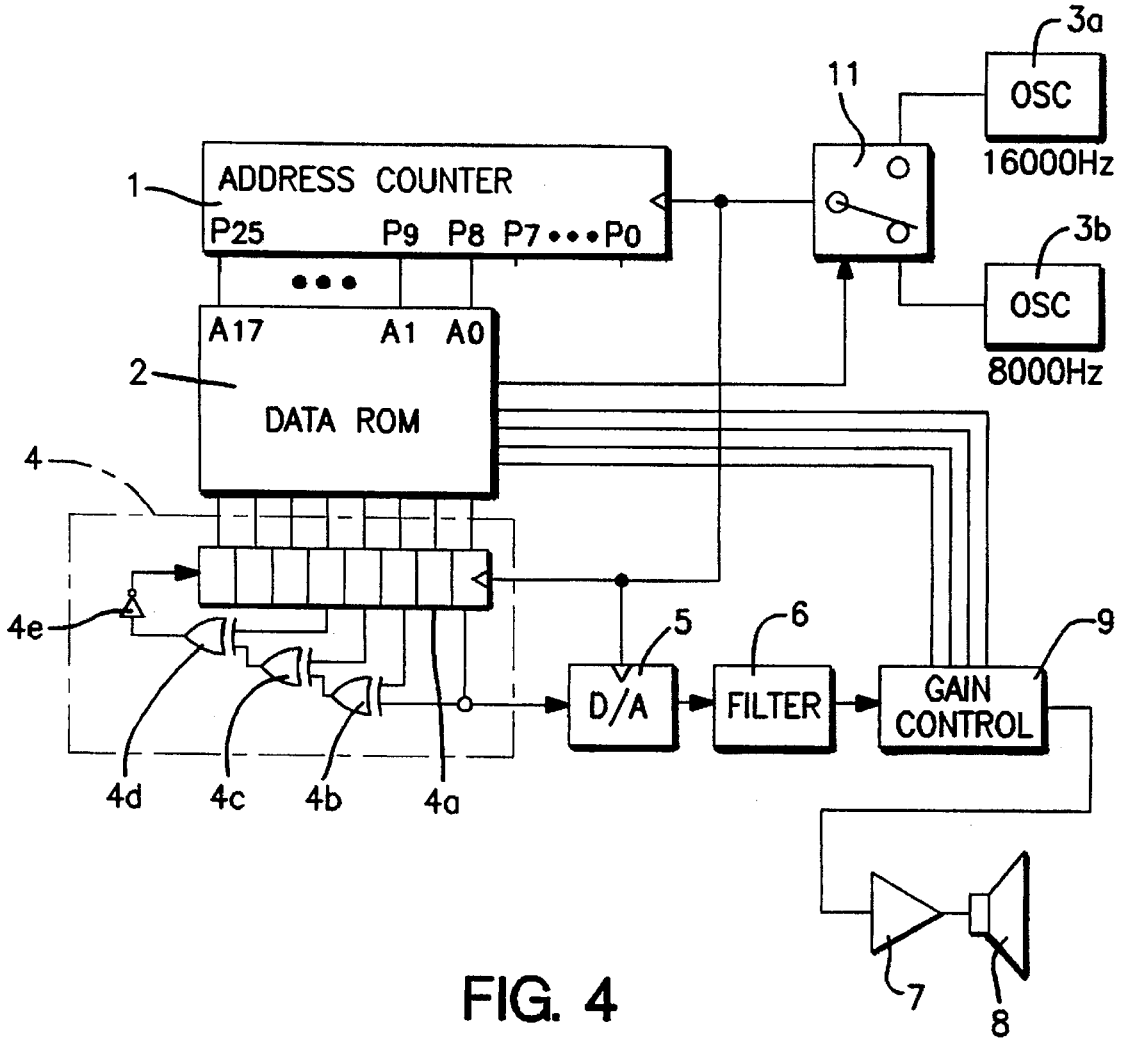
FIG. 4 is a block diagram illustrating a still further embodiment of the invention.

FIG. 4 illustrates a still further embodiment of the invention. In this embodiment, the oscillator 3 of the embodiment of FIG. 2 is replaced by two separate oscillators 3*a* and 3*b* having oscillation frequencies of 16,000 Hz and 8,000 Hz, respectively, and a switch circuit 11 is provided to switch between the two oscillators 3*a* and 3*b* to supply operating frequency to an address counter 1, a pseudo-random number generator 4 and a D/A converter 5. The data ROM 2 is a 13-bit address ROM, each address containing 8-bit coded data, 4-bit gain adjustment data, and 1-bit data for switching the operating frequency. The operating frequency switching data read from the data ROM 2 is fed to the switch circuit 11, and depending upon the value of the data, either oscillator 3*a* or 3*b* is selected.

The operating frequency switching data stored in the data ROM 2 is generated beforehand in the following manner: if the difference between the original voice data and the closest pattern obtained is greater than the threshold value in the encoding process, for example, the encoding process is performed over again with a higher operating frequency, and the data representing the kind of the used operating frequency is obtained as the operating frequency switching data to be stored in the data ROM 2 along with the associated coded data.

Thus, according to this embodiment, the operating frequency of the voice reproduction is changed according to the sampling frequency selected in the encoding process, thereby allowing the voice reproduction processing to be suitably performed even when the quantization error tends to increase. As a result, the voice reproduction of higher quality is realized although the data compression ratio decreases.

Figure 5:
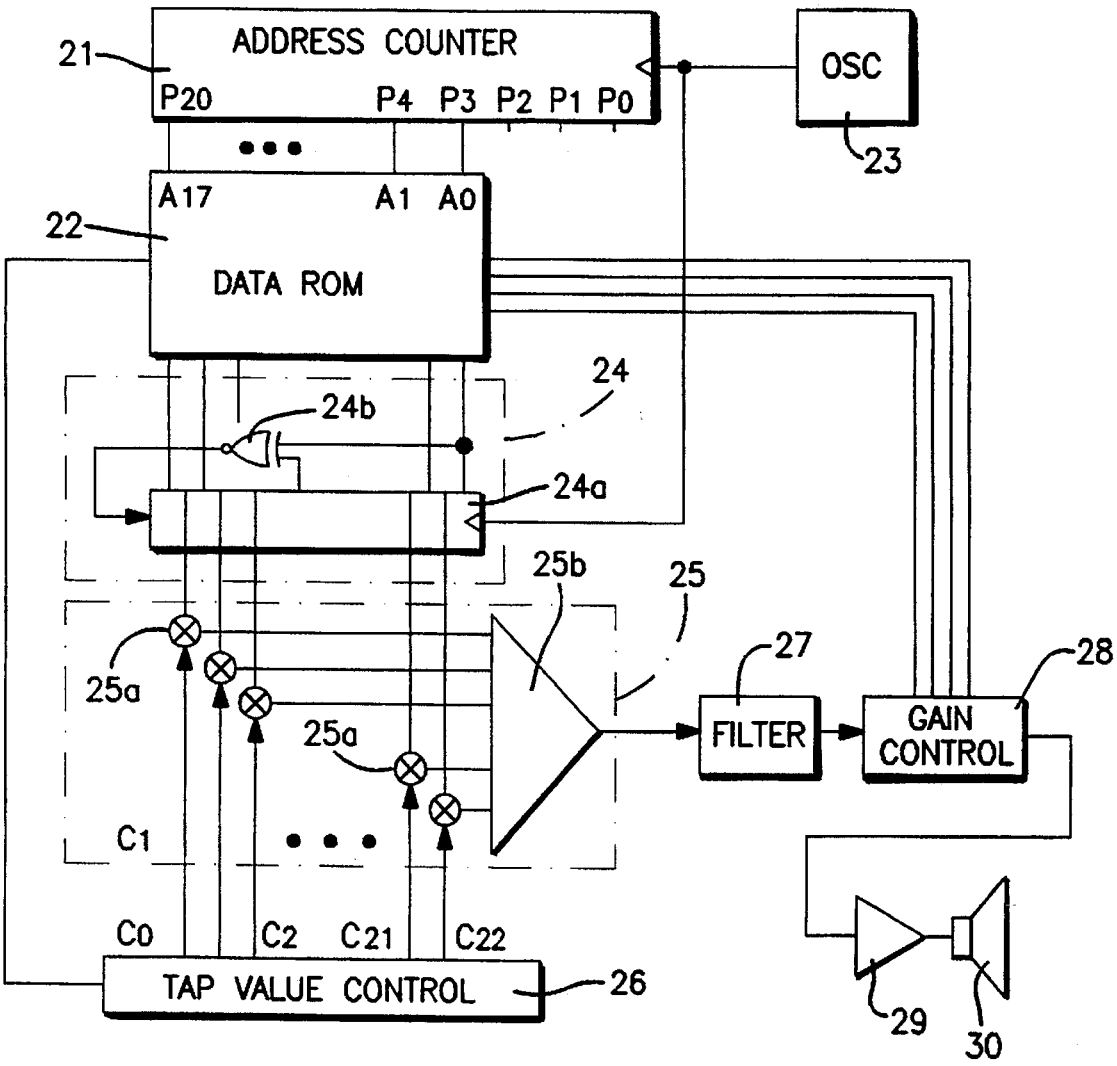
FIG. 5 is a block diagram illustrating a still further embodiment of the invention.
Figure 6:
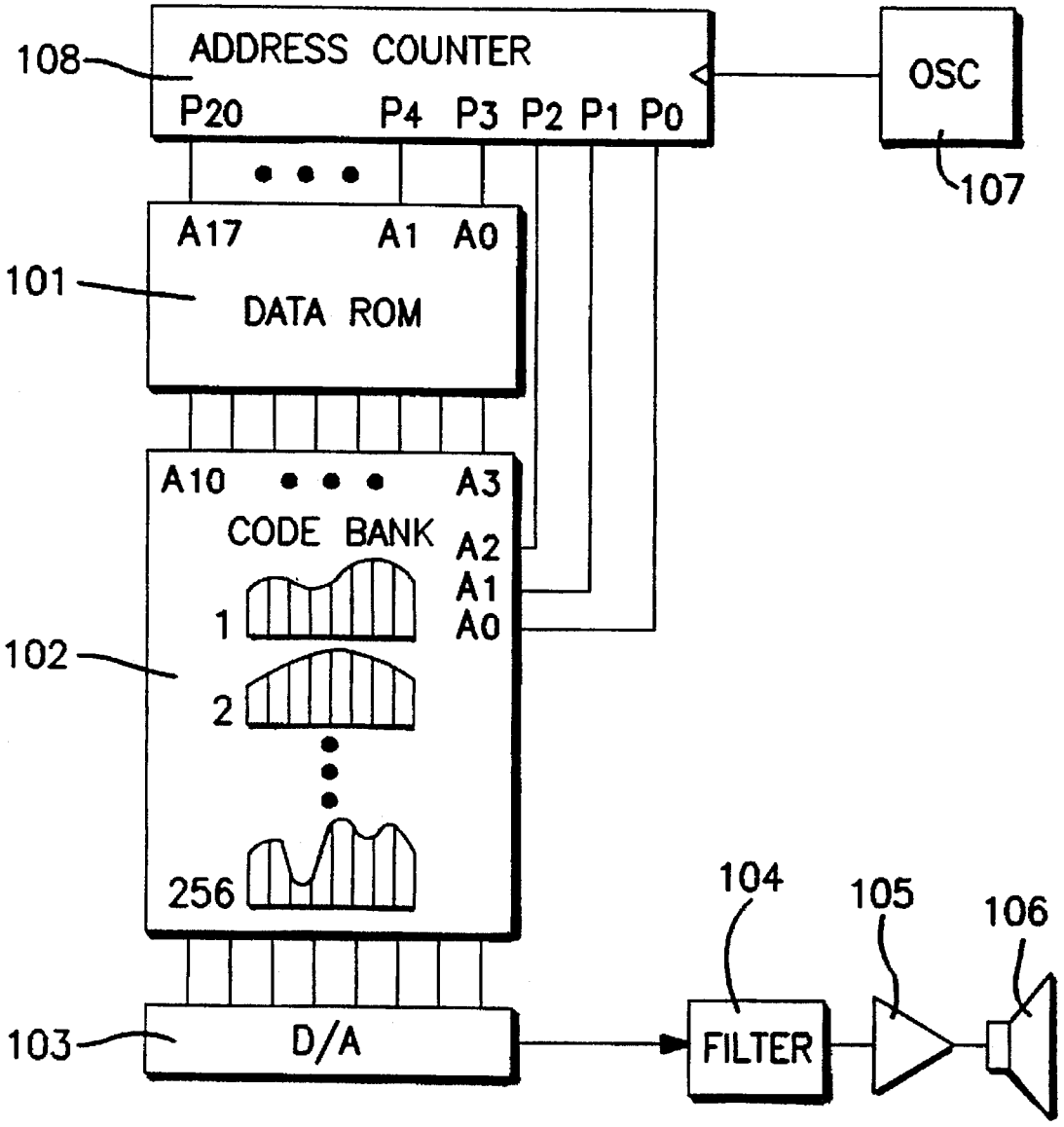
FIG. 6 PRIOR ART
FIG. 6 is a block diagram of a prior art voice signal reroducing device.

FIG. 5 shows a still further embodiment of the invention. In the voice signal reproducing device of this embodiment, the higher 18 bits of the output of an address counter 21 are connected to the 18-bit address input of a data ROM 22. The address counter 21 sequentially counts output values of 23 bits on the basis of the oscillation frequency (8,000 Hz) of an oscillator 23. Since the lower three bits of the output of the address counter 21 are not used, the address counter 21 provides counts to the data ROM 22 at a rate of one-eighth the oscillation frequency of the oscillator 23. The data ROM 22 contains coded data each consisting of initial value data, gain data, and tap value data and arranged in address sequence. The initial value data are sequentially read from the data ROM 22 by the count output of the address counter 21, and input in parallel to a shift register 24*a* in a pseudo-random number generator 24.

In the pseudo-random number generator 24, each bit in the shift register 24*a* is shifted sequentially to the next higher significant place in accordance with the oscillation frequency of the oscillator 23. The bits in the most significant stage and an intermediate stage are XORed by an XOR circuit 24*b*, and the result of the XOR is inverted and input to the first stage of the shift register 24*a* to generate M-sequence random numbers. That is, in the pseudo-random number generator 24, every time an initial value is given from the data ROM 22, the shift register 24*a* performs a shift operation eight times to output eight 23-bit data as one pattern.

Each pattern thus output sequentially from the pseudo-random number generator 24 is converted, with its bandwidth limited, to an analog signal by a converter 25. The converter 25 comprises: multipliers 25*a* that multiply the 23-bit parallel output of the shift register 24*a* by respective tap values C; and an adder 25*b* that adds up the outputs of the multipliers 25*a*. The converter 25 is also provided with a tap value controller 26 which updates the tap values C used for the multiplication by the multipliers 25*a* on the basis of the tap value data read from the data ROM 22.

The analog signal output from the adder 25*b* of the converter 25 is supplied to a filter 27 which removes aliasing noise, and, after its gain is adjusted by a gain controller 28, the analog signal is amplified by an amplifier 29 and reproduced as a voice through a loudspeaker 30. The gain controller 28 controls the gain of the analog signal for every pattern generated by the pseudo-random number generator 24, on the basis of the gain data read from the data ROM 22.

The initial data stored in the data ROM 22 are obtained beforehand by vector quantization by comparing every block of eight samples of the original voice signal to be recorded against all patterns produced by the same pseudo-random numbers as those generated by the pseudo-random number generator 24, and by sequentially outputting the initial value for the pattern closest to the original voice signal. Therefore, each pattern sequentially output from the pseudo-random number generator 24 by causing the shift register 24*a* to perform shift operations on the basis of the initial value data read from the data ROM 22 is the closest to the waveform representing eight samples of the original voice signal. Based on this pattern, the original voice is reconstructed and reproduced through the loudspeaker 30.

The tap value data stored in the data ROM is a value which is obtained by optimizing the bandwidth limiting characteristics for the patterns produced by pseudo-random numbers so that, when the initial value data are obtained by vector quantization, the quantization error is minimized. Therefore, by updating the tap values of the tap value controller on the basis of the tap value data, the analog signal output from the converter 25 can be made further closer to the original voice signal. Since the tap value data is read out every time a plurality of initial data and gain data are read from the data ROM 22, the tap value data is updated every time a plurality of patterns are output from the pseudo-random number generator 24. Therefore, the tap value data takes only a fraction of the capacity of the data ROM 22 and hardly affects the compression ratio of the voice data.

The gain data stored in the data ROM 22 represents an adjustment value so that the power of the voice signal to be compared against agrees with the power of each pattern (sum of squares of each sample). Therefore, if, in vector quantization, there is a pattern which is quite similar in waveform to but only different in level from the original signal, the initial values of this pattern can be adopted as coded data, thus virtually increasing the number of representative vectors and achieving a further decrease in the quantization error. In this embodiment, since 4-bit gain data is added to each 23-bit initial value data, the compression ratio of voice data somewhat decreases.

According to this embodiment, since 8-sample patterns can be generated in varieties equal to the 23th power of 2 by the simple pseudo-random number generator 24 comprising the shift register 24*a* and the XOR circuit 24*b*, the original voice signal can be reproduced with high quality without using a code book constructed with a large-capacity memory. Furthermore, by updating the tap values of the converter 25 for every output of a plurality of patterns, the bandwidth limiting characteristics can be optimized without sacrificing the versatility of the hardware. Also, since the gain of each pattern generated by the pseudo-random number generator 24 can be controlled so as to match the power of the original voice signal, further high quality is achieved.

As is apparent from the above description, according to the signal reproducing device of the invention, the patterns based on coded data can be generated by using a recurrence equation for pseudo-random numbers or the like, and hence there is no need to provide a large-capacity code book containing a large number of patterns, which serves to further simplify the hardware configuration of the device. Furthermore, since the number of patterns can be increased without appreciable strain on the hardware, it is also possible to reproduce versatile coded data. This enhances the simplicity of the hardware configuration and the possibility for mass production, thus contributing to a drastic reduction in the device costs, while achieving reproduction of high quality. Furthermore, since the bandwidth limiting characteristics for the patterns can be optimized as required, signal reproduction of further enhanced quality is made possible.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A signal reproducing device comprising:

coded data extracting means for extracting transferred or recorded coded data one by one;

recurrence means for executing a recurrence equation as a function of initial values;

pattern generating means for sequentially giving the coded data extracted by said coded data extracting means as said initial values to said recurrence means, and for sequentially generating a pattern composed of a predetermined plurality of data for every initial value; and reproduction data output means for sequentially outputting the patterns generated by said pattern generating means as reproduction data.

2. A signal reproducing device according to claim 1, wherein said coded data extracting means sequentially extracts gain adjustment data transferred or recorded along with each coded data, and said reproduction data output means performs gain adjustment for each corresponding pattern on the basis of the gain adjustment data extracted by said coded data extracting means.

3. A signal reproducing device according to claim 1 or 2, wherein said coded data extracting means further sequentially extracts operating speed data transferred or recorded along with the coded data, and said device further comprises an oscillator, the oscillation frequency of said oscillator varying on the basis of the operating speed data extracted by said coded data extracting means and being supplied as an operating frequency to said coded data extracting means, pattern generating means, and reproduction data output means.

4. A signal reproducing device comprising:

coded data extracting means for sequentially extracting a plurality of transferred or recorded coded data;

a plurality of recurrence means with each of said recurrence means executing a recurrence equation as a function of initial values;

a plurality of pattern generating means, each of said pattern generating means giving one of the plurality of coded data extracted by said coded data extracting means as an initial value to a respective recurrence means, and for generating a pattern composed of a predetermined plurality of data for every initial value; and reproduction data output means for performing a predetermined operation on the respective patterns generated by said plurality of pattern generating means, and for sequentially outputting the results of said operation as reproduction data.

5. A signal reproducing device according to claim 4, wherein said coded data extracting means sequentially extracts gain adjustment data transferred or recorded along with each coded data, and said reproduction data output means performs gain adjustment for each corresponding pattern on the basis of the gain adjustment data extracted by said coded data extracting means.

6. A signal reproducing device according to claim 4 or 5, wherein said coded data extracting means further sequentially extracts operating speed data transferred or recorded along with the coded data, and said device further comprises an oscillator, the oscillation frequency of said oscillator varying on the basis of the operating speed data extracted by said coded data extracting means and being supplied as an operating frequency to said coded data extracting means, pattern generating means, and reproduction data output means.

7. A signal reproducing device comprising:

coded data extracting means for extracting initial value data one by one from transferred or recorded coded data, and for extracting coefficient data one by one for every extraction of a plurality of initial value data;

recurrence means for executing a recurrence equation as a function of said initial values;

pattern generating means for sequentially giving initial value data extracted by said coded data extracting means as said initial values to said recurrence means, and for generating patterns each composed of a predetermined plurality of digital data for every initial value;

reproduction data output means for sequentially outputting the patterns generated by said pattern generating means as reproduction data; and coefficient setting means for sequentially setting the coefficient data extracted by said coded data extracting means as bandwidth limiting coefficients for said reproduction data output means.

8. A signal reproducing device according to claim 1, wherein said recurrence means comprises a shift register and means for performing a logic operation based on an output of said shift register and for providing a result of said logic operation as an input to said shift register.

9. A signal reproducing device according to claim 8, wherein said means for performing comprises at least one exclusive OR gate.

10. A signal reproducing device according to claim 8, wherein each of said initial values given to said recurrence means is stored initially in said shift register.

11. A signal reproducing device according to claim 4, wherein a first of said respective patterns generated by said plurality of pattern generating means represents original data including quantization error, and a second of said respective patterns represents said quantization error.

12. A signal reproducing device according to claim 11, wherein said predetermined operation comprises subtracting said second pattern from said first pattern.

13. A signal reproducing device according to claim 4, wherein each of said recurrence means comprises a shift register and means for performing a logic operation based on an output of said shift register and for providing a result of said logic operation as an input to said shift register.

14. A signal reproducing device, comprising:

memory means for storing a plurality of code words, each of said code words including coded data;

recurrence means for executing a recurrence equation as a function of initial values;

address means for selectively accessing said plurality of code words in said memory means;

pattern generating means for providing said coded data included in said selected code words to said recurrence means as said initial values, and for sequentially generating a pattern composed of a predetermined plurality of data for every initial value; and reproduction data output means for sequentially outputting the patterns generated by said pattern generating means as reproduction data.

15. A signal reproducing device according to claim 14, wherein each of said code words further comprises gain adjustment data, and said reproduction data output means performs gain adjustment for each pattern as a function of said gain adjustment data included in said selected code words.

16. A signal reproducing device according to claim 14, wherein each of said code words further comprises operating speed data, and said pattern generating means generates each pattern as a function of said operating speed data included in said selected code words.

17. A signal reproducing device according to claim 14, wherein said addressing means comprises a counter and whereby an output of said counter provides an address signal to said memory means.

18. A signal reproducing device according to claim 14, wherein said recurrence means comprises a shift register and means for performing a logic operation based on an output of said shift register and for providing a result of said logic operation as an input to said shift register.

19. A signal reproducing device according to claim 18, wherein each of said initial values given to said recurrence means is stored initially in said shift register.

* * * * *